US010366823B2

(12) United States Patent
Takagi et al.

(10) Patent No.: US 10,366,823 B2
(45) Date of Patent: Jul. 30, 2019

(54) COIL COMPONENT

(71) Applicant: TDK Corporation, Tokyo (JP)

(72) Inventors: Nobuo Takagi, Tokyo (JP); Kouyu Ohi, Yamagata (JP); Tasuku Mikogami, Tokyo (JP); Setu Tsuchida, Tokyo (JP)

(73) Assignee: TDK CORPORATION, Tokyo (JP)

( * ) Notice: Subject to any disclaimer, the term of this patent is extended or adjusted under 35 U.S.C. 154(b) by 109 days.

(21) Appl. No.: 15/401,504

(22) Filed: Jan. 9, 2017

(65) Prior Publication Data

US 2017/0200548 A1 Jul. 13, 2017

(30) Foreign Application Priority Data

Jan. 13, 2016 (JP) ..... 2016-004284

(51) Int. Cl.

| | |
|---|---|
| ***H01F 17/04*** | (2006.01) |
| ***H01F 27/28*** | (2006.01) |
| ***H01F 27/29*** | (2006.01) |
| ***H01F 27/30*** | (2006.01) |
| *H01F 3/10* | (2006.01) |

(52) U.S. Cl.

CPC ..... *H01F 27/2828* (2013.01); *H01F 27/292* (2013.01); *H01F 27/306* (2013.01); *H01F 3/10* (2013.01)

(58) Field of Classification Search

USPC ..... 336/221

See application file for complete search history.

(56) References Cited

U.S. PATENT DOCUMENTS

| | | | | |
|---|---|---|---|---|
| 7,855,627 | B2 * | 12/2010 | Nishikawa | H01F 17/045 336/200 |
| 8,937,522 | B2 * | 1/2015 | Lai | H01F 27/29 336/192 |
| 2010/0109827 | A1 * | 5/2010 | Asou | H01F 17/045 336/192 |
| 2015/0084731 | A1 | 3/2015 | Takagi et al. | |
| 2016/0133377 | A1 | 5/2016 | Takagi et al. | |

FOREIGN PATENT DOCUMENTS

| | | | |
|---|---|---|---|
| CN | 105097189 | A | 11/2015 |
| JP | 61-2311 | A | 1/1986 |
| JP | 06-196336 | A | 7/1994 |
| JP | 2014099588 | A | 5/2014 |
| JP | 2015-065272 | A | 4/2015 |
| JP | 2015-230968 | A | 12/2015 |

OTHER PUBLICATIONS

English translation of JP2014216347.*

* cited by examiner

*Primary Examiner* — Ronald Hinson
(74) *Attorney, Agent, or Firm* — Young Law Firm, P.C.

(57) ABSTRACT

Disclosed herein is a coil component that includes a drum-shaped core having a winding part, first and second terminal electrodes provided on the first flange part of the drum-shaped core, third and fourth terminal electrodes provided on the second flange part of the drum-shaped core, a first coil wound around the winding core part connected between the first and third terminal electrodes, and a second coil wound around the winding core part connected between the second and fourth terminal electrodes. The first and second coils cross each other at the first drawing part positioned between the winding part and the first flange part. The first coil is constituted by two or more wires.

17 Claims, 7 Drawing Sheets

COIL COMPONENT

BACKGROUND OF THE INVENTION

Field of the Invention

The present invention relates to a coil component and, more particularly, to a coil component using a drum-shaped core.

In recent years, electronic components used for an information terminal such as a smartphone are strongly required to reduce the size and particularly the height thereof. Thus, a large number of surface-mount type coil components not using a toroidal-shaped core but using a drum-shaped core exist as a coil component such as a pulse transformer. For example, Japanese Patent Application Laid-open No. 2015-065272 discloses a surface-mount type pulse transformer using a drum-shaped core.

A pulse transformer described in Japanese Patent Application Laid-open No. 2015-065272 includes two wires constituting a primary side coil and two wires constituting a secondary side coil. In this configuration, one of the wires constituting the primary side coil and one of the wires constituting the secondary side coil are wound clockwise, and the other one of the wires constituting the primary side coil and the other one of the wires constituting the secondary side coil are wound counterclockwise. Accordingly, the wires constituting the primary side coil and the wires constituting the secondary side coil cross one another a plurality of times at a winding core part of the drum-shaped core.

In a pulse transformer, the primary side coil and the secondary side coil need to be insulated from each other without fail. The wires are wound regularly on the winding core part so that even when the primary side coil and the secondary side coil cross each other a plurality of times, a strong electric field does not occur between them. On the other hand, an end portion of the wire is drawn from the winding core part to a flange part so as to be connected to a terminal electrode, and the wires constituting the primary side coil and wires constituting the secondary side coil may cross each other at the drawing part. In this case, a strong electric field may be applied to the crossing part to cause shortage of withstand voltage. In particular, when the wire is thermocompression bonded to the terminal electrode, heat generated at the thermocompression bonding is transmitted to the drawing part of the wire. This may degrade an insulating film and in turn decrease withstand voltage at the crossing part.

SUMMARY

The object of the present invention is therefore to provide a coil component in which withstand voltage at the wire drawing part is improved.

A coil component according to the present invention includes: a drum-shaped core including a winding core part, a first flange part provided at one end of the winding core part in an axial direction of the winding core part, and a second flange part provided at other end of the winding core part in the axial direction; first and second terminal electrodes provided on the first flange part; third and fourth terminal electrodes provided on the second flange part; a first coil wound around the winding core part, one end of the first coil being connected to the first terminal electrode and other end of the first coil is connected to the third terminal electrode; and a second coil wound around the winding core part, one end of the second coil being connected to the second terminal electrode and other end of the second coil is connected to the fourth terminal electrode. The first and second coils include a winding part at which the first and second coils are substantially regularly wound around the winding core part, a first drawing part positioned between the winding part and the first flange part, and a second drawing part positioned between the winding part and the second flange part, wherein the first and second coils cross each other at the first drawing part, and wherein the first coil is constituted by two or more wires.

According to the present invention, the first coil is constituted by two or more wires, so that, although the first and second coils cross each other at the first drawing part, electric filed intensity at the crossing part is alleviated. This allows withstand voltage at the drawing part to be enhanced.

In this case, winding directions of the first and second coils at the winding part may be opposite each other. Further, the first and second coils need not cross each other at the second drawing part.

Preferably, the coil component according to the present invention further includes third and fourth coils wound around the winding core part. The third and fourth coil include a winding part at which they are regularly wound around the winding core part, a first drawing part positioned between the winding part and the first flange part, and a second drawing part positioned between the winding part and the second flange part. The third and fourth coils cross each other at the second drawing part. The third coil is preferably constituted by two or more wires. In this structure, although the third and fourth coils cross each other at the second drawing part, since the third coil is constituted by two or more wires, electric filed intensity at the crossing part is alleviated.

In this case, winding directions of the first and fourth coils at the winding part may be the same, winding directions of the second and third coils at the winding part may be the same, and the winding direction of the first and fourth coils and the winding direction of the second and third coils may be opposite each other at the winding part. Further, the third and fourth coils need not cross each other at the first drawing part.

In the present invention, the length of the first drawing part in the axial direction may be larger than the length of the second drawing part in the axial direction. In this case, preferably the first and second coils cross each other at the first drawing part such that the first coil covers the second coil on the winding core part, and the third and fourth coils cross each other at the second drawing part such that the fourth coil covers the third coil on the winding core part. With this configuration, physical stress applied to the wire crossing part can be relieved.

Preferably, the coil component according to the present invention further includes a fifth terminal electrode provided on the first flange part and a sixth terminal electrode provided on the second flange part. One end of the third coil is connected to the fifth terminal electrode, and the other end thereof is connected to the third terminal electrode. One end of the fourth coil is connected to the second terminal electrode, and the other end thereof is connected to the sixth terminal electrode. With this configuration, the coil component of the invention can be used as a six-terminal pulse transformer.

Preferably, the coil component according to the present invention further includes fifth and sixth terminal electrodes provided on the first flange part and seventh and eighth terminal electrodes provided on the second flange part. One end of the third coil is connected to the fifth terminal electrode, and the other end thereof is connected to the seventh terminal electrode. One end of the fourth coil is connected to the sixth terminal electrode, and the other end thereof is connected to the eighth terminal electrode. With this configuration, the coil component of the invention can be used as an eight-terminal pulse transformer.

According to the present invention, there can be provided a coil component in which withstand voltage at the wire drawing part is improved.

BRIEF DESCRIPTION OF THE DRAWINGS

The above and other objects, features and advantages of this invention will become more apparent by reference to the following detailed description of the invention taken in conjunction with the accompanying drawings, wherein.

DETAILED DESCRIPTION OF THE EMBODIMENTS

Preferred embodiments of the present invention will now be explained in detail with reference to the drawings.

Figure 1:
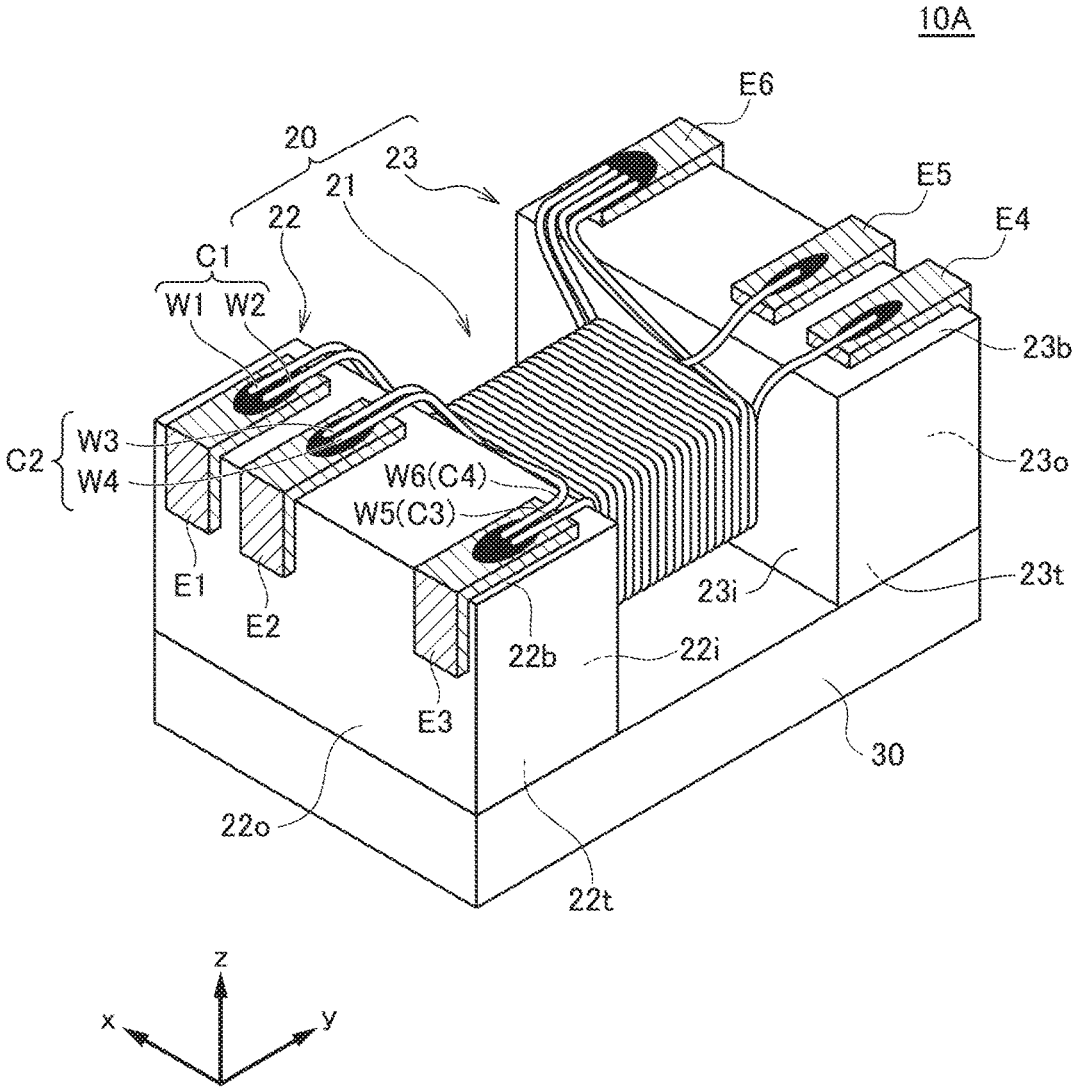
FIG. 1 is a schematic perspective view illustrating an external appearance of a coil component according to a first embodiment of the present invention.

FIG. 1 is a schematic perspective view illustrating an external appearance of a coil component 10A according to the first embodiment of the present invention.

The coil component 10A according to the present embodiment is a surface-mount type pulse transformer. As illustrated in FIG. 1, the coil component 10A includes a drum-shaped core 20, a plate-like core 30 bonded to the drum-shaped core 20, and wires W1 to W6 wound around a winding core part 21 of the drum-shaped core 20. The coil component according to the present invention is not limited to a pulse transformer, but may be any one of other transformer components such as a balun transformer or a booster transformer, or may be a filter component such as a common mode choke coil.

The drum-shaped core 20 and the plate-like core 30 are formed of a magnetic material having comparatively high permeability, such as a sintered body of a Ni—Zn ferrite or Mn—Zn ferrite. In general, a magnetic material having high permeability, such as Mn—Zn ferrite, is low in specific resistance and has conductivity.

The drum-shaped core 20 has a rod-like winding core part 21 whose axial direction is the y-direction and first and second flange parts 22 and 23 provided at both ends of the winding core part 21 in the y-direction. The winding core part 21 and the flange parts 22 and 23 are integrally formed. The flange part 22 has an inner side surface 22*i* connected to the winding core part 21, an outer side surface 22*o* positioned on the opposite side of the inner side surface 22*i*, a bottom surface 22*b* extending parallel to the axial direction of the winding core part 21, and a top surface 22*t* positioned on the opposite side of the bottom surface 22*b*. Similarly, the flange part 23 has an inner side surface 23*i* connected to the winding core part 21, an outer side surface 23*o* positioned on the opposite side of the inner side surface 23*i*, a bottom surface 23*b* extending parallel to the axial direction of the winding core part 21, and a top surface 23*t* positioned on the opposite side of the bottom surface 23*b*. The inner side surfaces 22*i* and 23*i* and the outer side surfaces 22*o* and 23*o* constitute the xz plane, and the bottom surfaces 22*b* and 23*b* and the top surfaces 22*t* and 23*t* constitute the xy plane.

The coil component 10A is a component surface-mounted on a printed circuit board in actual use and is mounted with the bottom surfaces 22*b* and 23*b* of the respective flange parts 22 and 23 facing the printed circuit board. The plate-like core 30 is bonded by adhesive to the top surfaces 22*t* and 23*t* of the respective flange parts 22 and 23. With such a configuration, the drum-shaped core 20 and the plate-like core 30 constitute a closed magnetic path.

As illustrated in FIG. 1, three terminal electrodes E1 to E3 are arranged in this order in the x-direction on the bottom surface 22*b* and the outer side surface 22*o* of the flange part 22, and three terminal electrodes E4 to E6 are arranged in this order in the x-direction on the bottom surface 23*b* and the outer side surface 23*o* of the flange part 23. The terminal electrodes E1 to E6 are L-shaped terminal metal fittings and bonded by adhesive to the flange part 22 or 23. By using the L-shaped terminal metal fitting, it is possible to reduce the production cost as compared with a case where the terminal electrodes E1 to E6 are formed by baking metal paste thereonto.

In the present embodiment, the distance between the terminal electrodes E2 and E3 in the x-direction is larger than the distance between the terminal electrodes E1 and E2 in the x-direction. Similarly, the distance between the terminal electrodes E5 and E6 in the x-direction is larger than the distance between the terminal electrodes E4 and E5 in the x-direction. This is to ensure withstand voltage between the primary and secondary sides at the flange parts 22 and 23.

Six wires, W1 to W6, are wound around the winding core part 21. One ends of the wires W1 and W2 are connected to the terminal electrode E1, and the other ends thereof are connected to the terminal electrode E6. Thus, the two wires W1 and W2 constitute one coil C1. One ends of the wires W3 and W4 are connected to the terminal electrode E2, and the other ends thereof are connected to the terminal electrode E6. Thus, the two wires W3 and W4 constitute one coil C2. One ends of the wires W5 and W6 are connected to the terminal electrode E3, and the other ends thereof are connected respectively to the terminal electrodes E5 and E4. Thus, the wires W5 and W6 constitute coils C3 and C4, respectively. The wires W1 to W6 are each connected to a part of the terminal electrode that covers the bottom surface 22*b* or 23*b*. Although not especially limited, the connection can be achieved by thermocompression or laser joining.

Figure 2:
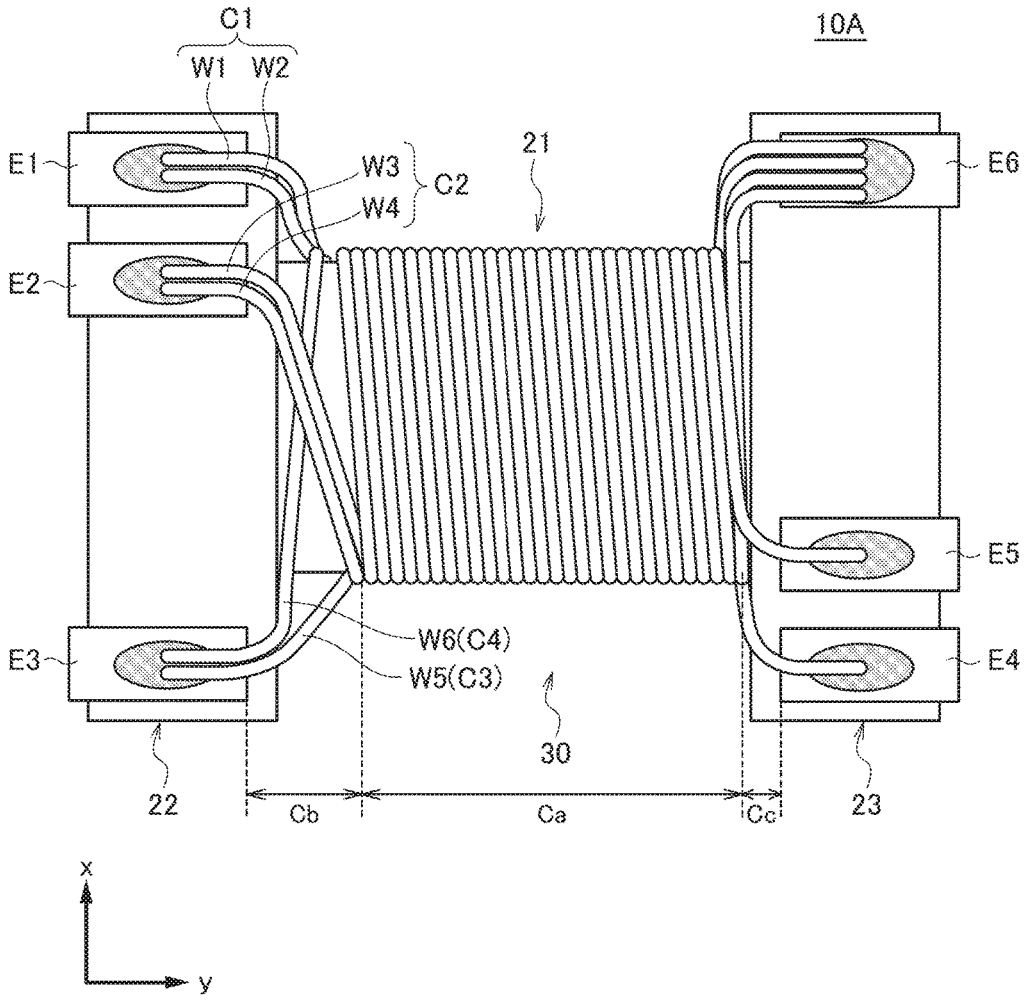
FIG. 2 is a plan view of the coil component shown in FIG. 1 as viewed in the z-direction.

FIG. 2 is a plan view of the coil component 10A as viewed in the z-direction.

As illustrated in FIG. 2, the coils C1 to C4 constituted by the six wires W1 to W6 include a winding part Ca at which they are regularly wound around the winding core part 21, a first drawing part Cb positioned between the winding part Ca and the first flange part 22, and a second drawing part Cc positioned between the winding part Ca and the second flange part 23. The first drawing part Cb is a part at which one ends of the wires W1 to W6 are drawn from the winding part Ca so as to be connected to the terminal electrodes E1 to E3. Similarly, the second drawing part Cc is a part at which the other ends of the wires W1 to W6 are drawn from the winding part Ca so as to be connected to the terminal electrodes E4 to E6. Although not especially limited, in the present embodiment, the length of the first drawing part Cb in the y-direction is longer than the length of the second drawing part Cc in the y-direction.

The wires W1 and W2 constituting the coil C1 are wound counterclockwise from the terminal electrode E1 toward the terminal electrode E6. The wires W3 and W4 constituting the coil C2 are wound clockwise from the terminal electrode E2 toward the terminal electrode E6. The wire W5 constituting the coil C3 is wound clockwise from the terminal electrode E3 toward the terminal electrode E5. The wire W6 constituting the coil C4 is wound counterclockwise from the terminal electrode E3 toward the terminal electrode E4. The coil C1 constitutes, e.g., a third coil, the coil C2 constitutes, e.g., a first coil, the coil C3 constitutes, e.g., a fourth coil, and the coil C4 constitutes, e.g., a second coil.

Figure 3:
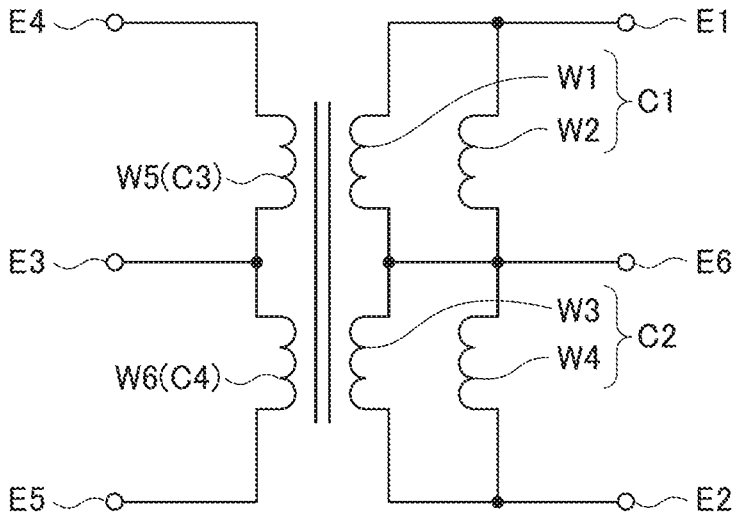
FIG. 3 is an equivalence circuit diagram of the coil component shown in FIG. 1.

With the above configuration, the coil component 10A according to the present embodiment constitutes the circuit illustrated in FIG. 3. That is, a pulse transformer circuit is configured, in which the terminal electrodes E4 and E5 are used as a pair of primary side terminal pair, the terminal electrodes E1 and E2 are as a secondary side terminal pair, the terminal electrode E3 is as a primary side center tap, and the terminal electrode E6 as a secondary side center tap. This allows a signal component to pass while insulating the primary and secondary sides in DC.

As a matter of course, in the pulse transformer, insulation needs to be ensured between the primary side coils C3 and C4 and the secondary side coils C1 and C2. Withstand voltage may be lowered at a portion where the primary side coils C3 and C4 and the secondary side coils C1 and C2 are in proximity to each other. However, at the winding part Ca where the coils C1 to C4 are regularly wound, an electric field generated between the primary side coils C3 and C4 and the secondary side coils C1 and C2 is deconcentrated, so that the problem about withstand voltage at this portion can be avoided.

On the other hand, at the first drawing part Cb, the wire W6 constituting the primary side coil C4 and the wires W3 and W4 constituting the secondary coil C2 cross each other, so that an electric field is concentrated at the crossing part to lower withstand voltage. Similarly, at the second drawing part Cc, the wire W5 constituting the primary side coil C3 and the wires W1 and W2 constituting the secondary coil C1 cross each other, so that an electric field is concentrated at the crossing part to lower withstand voltage.

However, in the coil component 10A according to the present embodiment, one (C1 or C2) of the two crossing coils is constituted by two wires (W1 and W2, or W3 and W4). Thus, as compared with a case where both the two crossing coils are each constituted by a single wire, concentration of the electric field is alleviated. Thus, as compared with a case here the coils C1 to C4 are each constituted by a single wire, higher withstand voltage can be ensured.

At the second drawing part Cc, the wire W6 constituting the primary side coil C4 and the wires W3 and W4 constituting the secondary side coil C2 do not cross each other. Similarly, at the first drawing part Cb, the wire W5 constituting the primary side coil C3 and the wires W1 and W2 constituting the secondary side coil C1 do not cross each other.

The wires W1 to W6 can be wound by the following method. First, the other ends of the wires W1 and W2 are connected to the terminal electrode E6, and the other end of the wire W6 is connected to the terminal electrode E4, and then the drum-shaped core 20 is rotated to wind the wires W1, W2, and W6 around the winding core part 21 in the rotation direction of the drum-shaped core 20. Then, one ends of the wires W1 and W2 are connected to the terminal electrode E1, and one end of the wire 6 is connected to the terminal electrode E3, whereby the formation of the coils C1 and C4 are completed. The wire connection is made by, e.g., thermocompression bonding, and heat applied at the thermocompression bonding is transmitted to the wires W1, W2, and W6, so that insulating film on the wires W1, W2, and W6 may be degraded at the first drawing part Cb or the second drawing part Cc.

Then, one ends of the wires W3 and W4 are connected to the terminal electrode E2, and one end of the wire W5 is connected to the terminal electrode E3, and then the drum-shaped core 20 is rotated again to wind the wires W3, W4, and W5 around the winding core part 21 in the rotation direction of the drum-shaped core 20. Then, the other ends of the wires W3 and W4 are connected to the terminal electrode E6, and the other end of the wire W5 is connected to the terminal electrode E5, whereby the formation of the coils C2 and C3 are completed. The wire connection for the wires W3, W4, and W5 is also made by, e.g., thermocompression bonding, and heat applied at the thermocompression bonding is transmitted to the wires W3, W4, and W5, so that insulating film on the wires W3, W4, and W5 may be degraded at the first drawing part Cb or the second drawing part Cc.

Therefore, the wire W6 and wires W3, W4 that cross each other at the first drawing part Cb may lack in withstand voltage at the crossing part. Similarly, the wire W5 and wires W1, W2 that cross each other at the second drawing part Cc may lack in withstand voltage at the crossing part. However, as described above, one of the two crossing coils is constituted by two wires in the present embodiment, so that concentration of the electric field is alleviated to thereby prevent withstand voltage from being lowered.

Further, according to the above-described winding method, the wires W1, W2, and W6 are wound counterclockwise in the first winding process, and the wires W3, W4, and W5 are wound clockwise in the second winding process. Further, in order to arrange the wires W1 to W6 more regularly at the winding part Ca, it is preferable to reduce the length of the second drawing part Cc in the y-direction. That is, when the inner side surface 23*i* of the flange part 23 is used as a positioning part for the winding start portion of each of the wires W1, W2, and W6 by bringing the first turn of each of the wires W1, W2, and W6 closer to the flange part 23, the wires W1 to W6 can be arranged more regularly at the winding part Ca. In this case, a space in accordance with a design margin is generated for the first drawing part Cb, so that the length of the first drawing part Cb in the y-direction is longer than that of the second drawing part Cc in the y-direction.

Figure 4A:
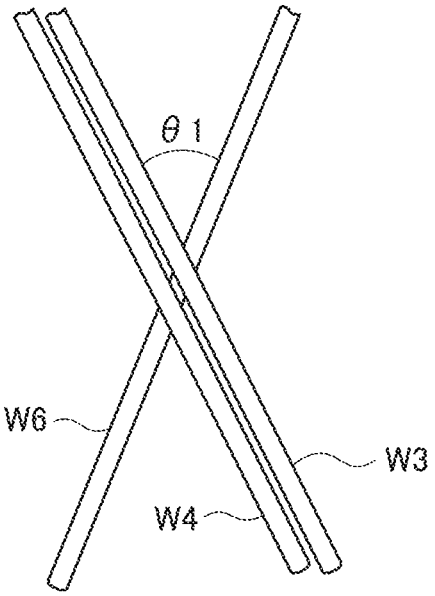
FIGS. 4A and 4B are enlarged views illustrating the crossing parts of the wires.
Figure 4B:
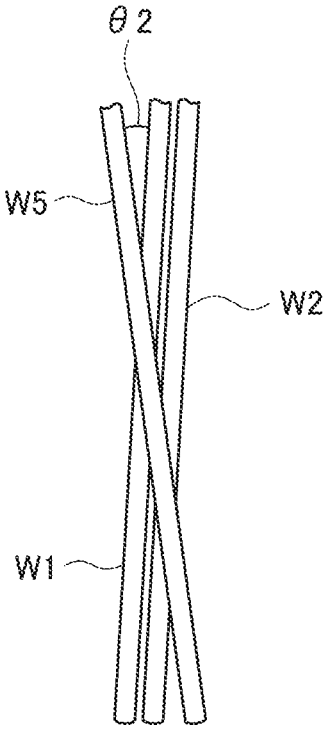

FIGS. 4A and 4B are enlarged views illustrating the crossing parts of the wires W1 to W6. FIG. 4A illustrates the crossing part at the first drawing part Cb, and FIG. 4B illustrates the crossing part at the second drawing part Cc.

As described above, the length of the first drawing part Cb in the y-direction is longer than that of the second drawing part Cc in the y-direction, so that, as illustrated in FIGS. 4A and 4B, a crossing angle θ1 between the wires W3, W4 and the wire W6 that cross at the first drawing part Cb is larger than a crossing angle θ2 between the wires W1, W2 and the wire W5 that cross at the second drawing part Cc.

The wire crossing angle has influence on physical stress that the upper side wire gives to the lower wire. This is because the smaller the wire crossing angle is, the longer a contact range between the crossing wires, so that physical stress that the upper side wire gives to the lower wire becomes large.

Considering this point, in the present embodiment, the two wires W3 and W4 cover a single wire, i.e. wire 6 at the first drawing part Cb where the crossing angle (θ1) is large, and a single wire, i.e. W5 covers the two wires W1 and W2 at the second drawing part Cc where the crossing angle (θ2) is small. Hence, at the second drawing part Cc where large physical stress is applied, the upper side is constituted by a single wire and the lower side by two wires. As a result, the lower side wires are less influenced by the physical stress from the upper wire, and receive deconcentrated physical stress because of the two wire construction. With this configuration, a defect such as wire disconnection or peeling-off of the wire connection part hardly occurs.

In addition, in the coil component 10A according to the present embodiment, the coils C1 and C2 are each constituted by two wires, so that the coils C1 and C2 have lower DC resistance than the coils C3 and C4. Considering this, the coil component 10A according to the present embodiment is preferably used as a pulse transformer for Power over Ethernet (PoE).

Figure 5:
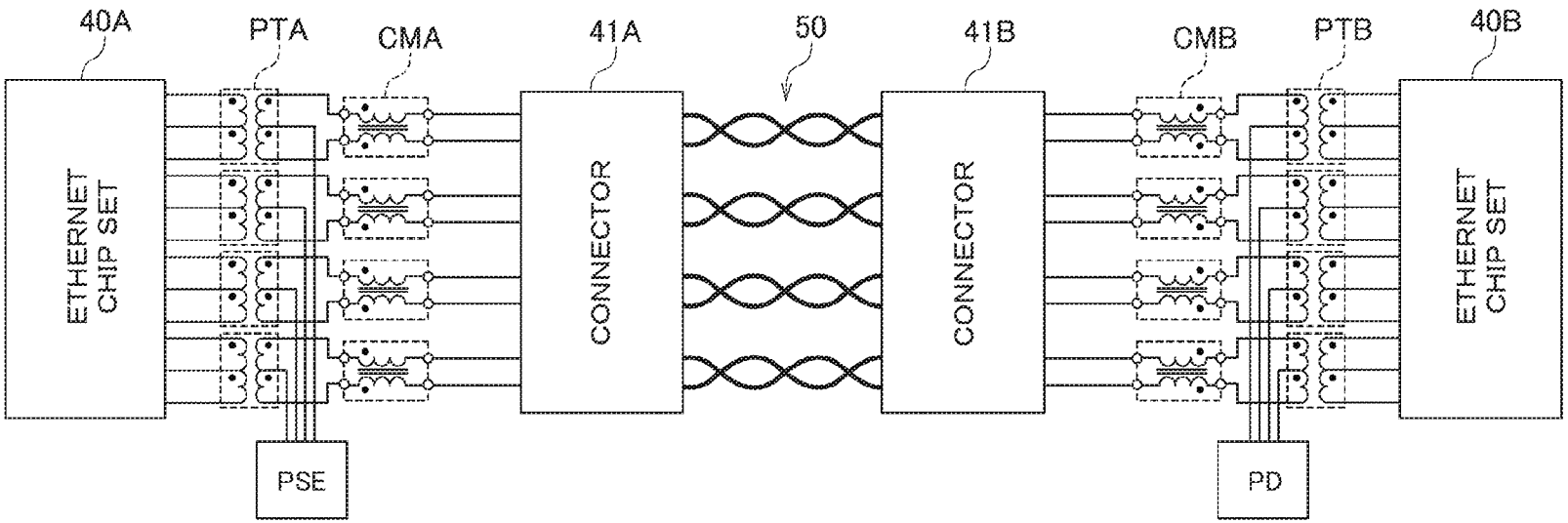
FIG. 5 is a circuit diagram illustrating a PoE circuit.

FIG. 5 is a circuit diagram illustrating a PoE circuit.

The PoE circuit illustrated in FIG. 5 is a circuit in which two Ethernet chip sets 40A and 40B are connected by eight lines of Ethernet cables 50. Opposite ends of the Ethernet cables 50 are connected to the Ethernet chip sets 40A and 40B, respectively, through connectors 41A and 41B. Four pulse transformers PTA and four common mode filters CMA are connected between the Ethernet chip set 40A and the connector 41A. Similarly, four pulse transformers PTB and four common mode filters CMB are connected between the Ethernet chip set 40B and the connector 41B.

Assuming that, of the terminals constituting each pulse transformer PTA, those at the Ethernet chip set 40A side serve as the primary side, and those at the connector 41A side serve as the secondary side, secondary side center taps of the pulse transformers PTA are connected to a power supply circuit PSE. The power supply circuit PSE is a circuit that supplies DC voltage to the secondary side center taps of the pulse transformers PTA.

On the other hand, assuming that, of the terminals constituting each pulse transformer PTB, those at the Ethernet chip set 40B side serve as the primary side, and those at the connector 41B side serve as the secondary side, secondary side center taps of the pulse transformers PTB are connected to a load circuit PD. The load circuit PD is a circuit that operates using DC voltage supplied from the secondary side center taps of the pulse transformers PTB as a power source.

As a result, the DC voltage supplied from the power supply circuit PSE is supplied to the load circuit PD through the Ethernet cables 50.

In the above-configured pulse transformers PTA and PTB, only a signal component is applied at the primary side, while power supply voltage is superimposed on the signal component at the secondary side, so that DC resistance of the coil constituting the secondary side needs to be made small as much as possible. Thus, when the coil component 10A according to the present embodiment is used as the pulse transformers PTA and PTB, and the coils C1 and C2 are used as the secondary side, the DC resistance of a power supply path from the power supply circuit PSE to the load circuit PD can be reduced.

As another possible approach to reduction of the DC resistance of the coils C1 and C2, a single wire having a larger diameter may be employed in place of two wires to constitute one coil. However, when the diameter of the wire constituting the coils C1 and C2 and that of the wire constituting the coils C3 and C4 differ from each other, not only winding work or wire connection work become difficult, but also it becomes difficult to regularly wind the wires around the winding core part 21, which may deteriorate coupling characteristics. In contrast, since the six wires W1 to W6 have the same diameter in the present embodiment, such the foregoing problem by no means occurs.

Further, in the coil component 10A according to the present embodiment, the coils C3 and C4 are each constituted by one wire, so that increase in parasitic capacitance between coils can be suppressed as compared with a case where the coils C1 to C4 are each constituted by two wires. Thus, when the coil component 10A is used as the pulse transformer, high signal quality can be ensured.

Figure 6:
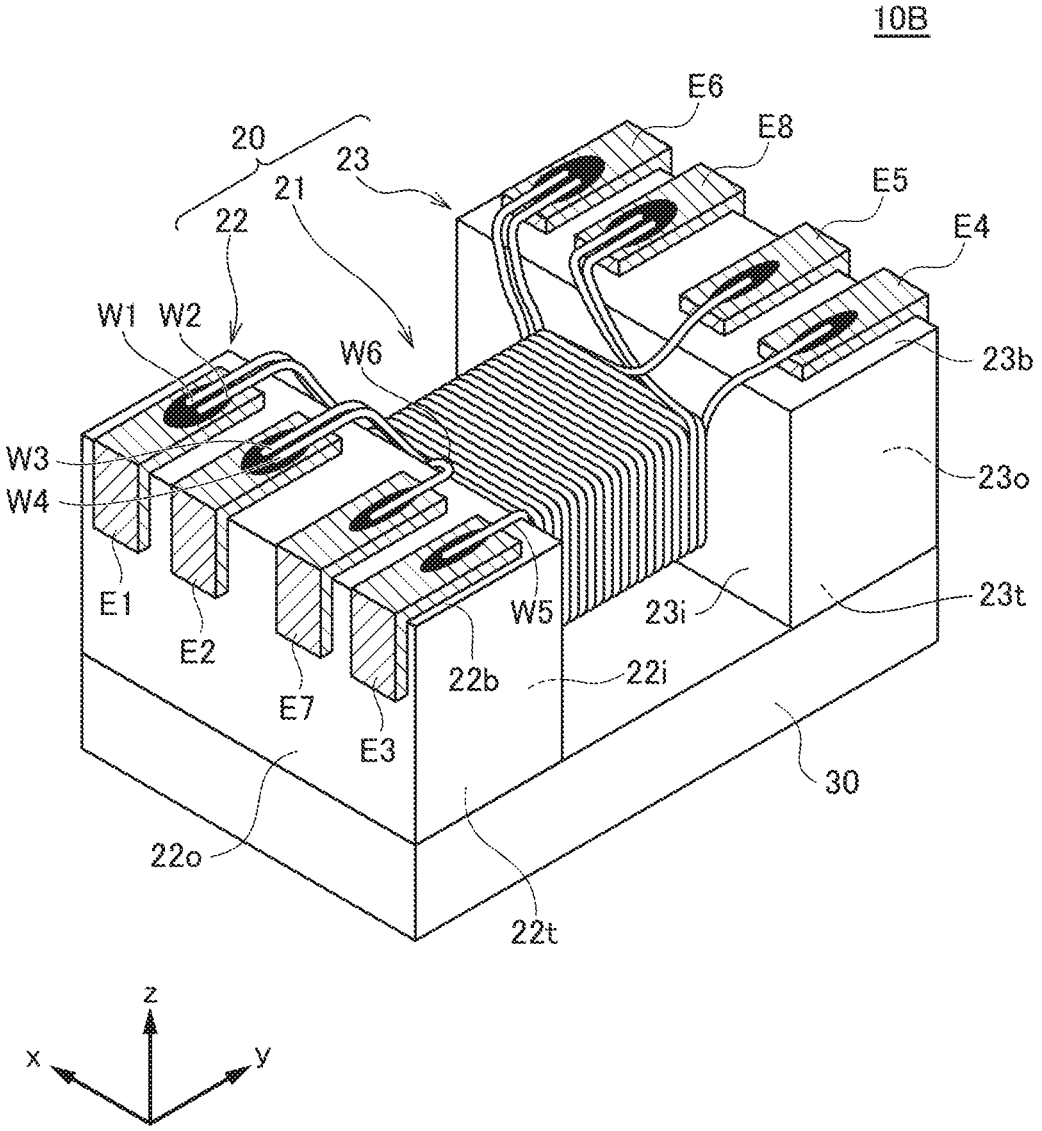
FIG. 6 is a schematic perspective view illustrating an external appearance of a coil component according to a second embodiment of the present invention.
Figure 7:
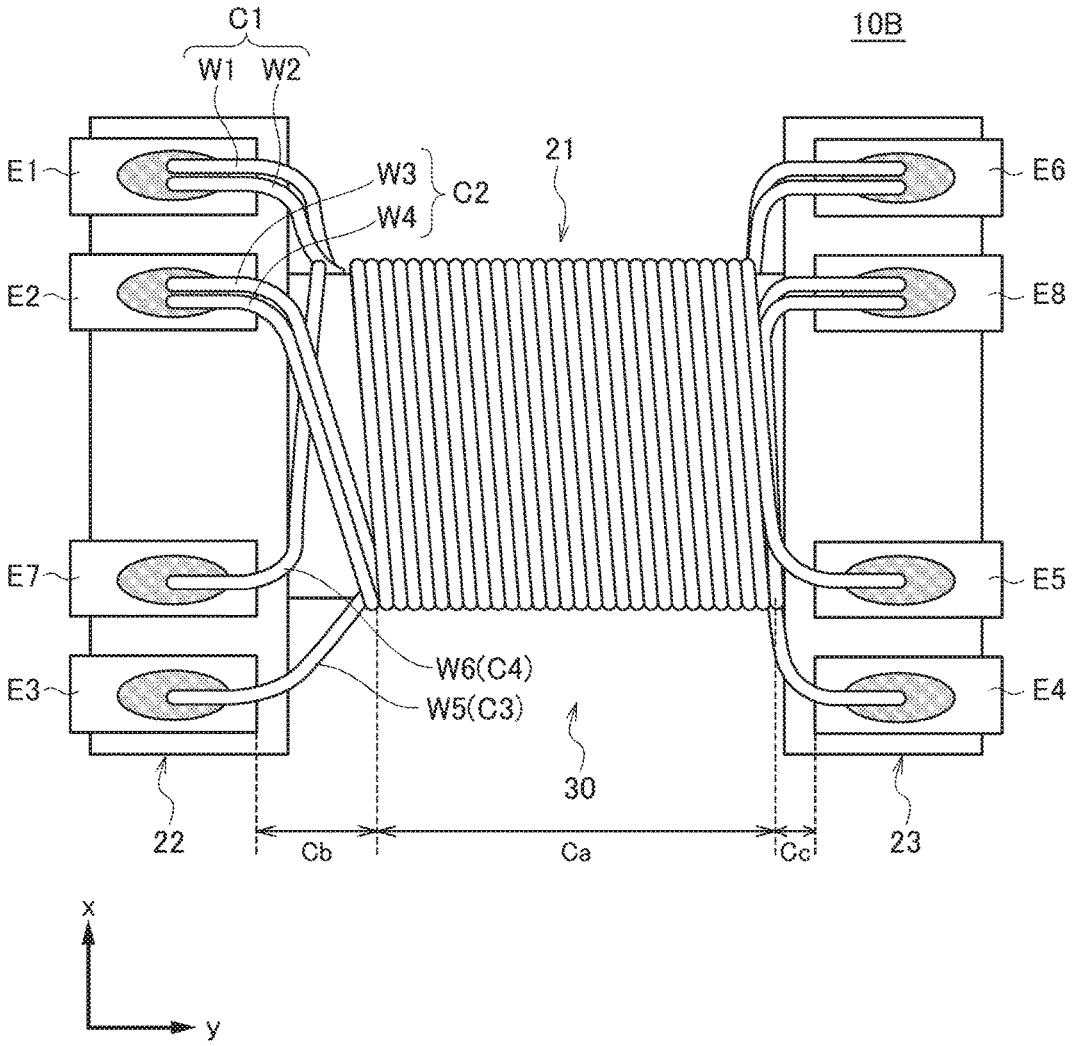
FIG. 7 is a plan view of the coil component shown in FIG. 6 as viewed in the z-direction.

FIG. 6 is a schematic perspective view illustrating an external appearance of a coil component 10B according to the second embodiment of the present invention. FIG. 7 is a plan view of the coil component 10B as viewed in the z-direction.

As illustrated in FIGS. 6 and 7, the coil component 10B according to the second embodiment differs from the coil component 10A according to the first embodiment in that terminal electrodes E7 and E8 are additionally provided. Other configurations are basically the same as those of the coil component 10A of the first embodiment, so the same reference numerals are given to the same elements, and overlapping description will be omitted.

The terminal electrode E7 is provided on the first flange part 22 and disposed between the terminal electrodes E2 and E3. The distance between the terminal electrodes E7 and E3 in the x-direction is substantially the same as the distance between the terminal electrodes E1 and E2 in the x-direction, but the distance between the terminal electrodes E7 and E2 in the x-direction is larger than the distance between the terminal electrodes E1 and E2 in the x-direction. This is to ensure withstand voltage between the primary and secondary sides at the flange part 22.

The terminal electrode E8 is provided on the second flange part 23 and disposed between the terminal electrodes E5 and E6. The distance between the terminal electrodes E8 and E6 in the x-direction is substantially the same as the distance between the terminal electrodes E4 and E5 in the x-direction, but the distance between the terminal electrodes E8 and E5 in the x-direction is larger than the distance between the terminal electrodes E4 and E5 in the x-direction. This is to ensure withstand voltage between the primary and secondary sides at the flange part 23.

The terminal electrode E7 is connected with one end of the wire W6 constituting the coil C4. The terminal electrode E8 is connected with the other ends of the wires W1 and W2 constituting the coil C1. Thus, by short-circuiting the terminal electrodes E3 and E7 and short-circuiting the terminal electrodes E6 and E8 on the printed circuit board, the coil component 10B of the second embodiment can achieve the same function as that of the coil component 10A of the first embodiment.

It is apparent that the present invention is not limited to the above embodiments, but may be modified and changed without departing from the scope and spirit of the invention.

For example, while the coils C1 and C2 are each constituted by two wires in the above embodiments, they may each be constituted by three or more wires.

Further, in the coil components 10A and 10B according to the above respective embodiments, the L-shaped terminal metal fitting is used as the terminal electrodes E1 to E8; alternatively, however, the terminal electrodes E1 to E8 may be formed by baking metal paste onto the flange parts 22 and 23.

Further, although the coil components 10A and 10B according to the above respective embodiments each include the plate-like core 30, it is not essential for the coil component of the present invention to include the plate-like core 30.

Further, it is not essential for the terminal electrodes E1 to E8 to be formed into the L-shape. For example, in the coil component 10A, a U-like shape may be adopted for the terminal electrodes E1 to E3 and E4 to E6 so that the former further covers the top surface 22*t* of the flange part 22 and the latter the top surface 23*t* of the flange part 23.

What is claimed is:

1. A coil component comprising:

a drum-shaped core including a winding core part, a first flange part provided at one end of the winding core part in an axial direction of the winding core part, and a second flange part provided at other end of the winding core part in the axial direction;

first and second terminal electrodes provided on the first flange part;

third and fourth terminal electrodes provided on the second flange part;

a first coil wound around the winding core part, one end of the first coil being connected to the first terminal electrode and other end of the first coil is connected to the third terminal electrode;

a second coil wound around the winding core part, one end of the second coil being connected to the second terminal electrode and other end of the second coil is connected to the fourth terminal electrode, wherein the first and second coils include a winding part at which the first and second coils are substantially regularly wound around the winding core part, a first drawing part positioned between the winding part and the first flange part, and a second drawing part positioned between the winding part and the second flange part, the first and second coils cross each other at the first drawing part, the first coil is constituted by two or more wires, and the second coil is constituted by a single wire; and third and fourth coils wound around the winding core part, wherein the third and fourth coils include a winding part at which the third and fourth coils are substantially regularly wound around the winding core part, a first drawing part positioned between the winding part and the first flange part, and a second drawing part positioned between the winding part and the second flange part, the third and fourth coils cross each other at the second drawing part, the third coil is constituted by two or more wires, and the fourth coil is constituted by a single wire.

2. The coil component as claimed in claim 1, wherein winding directions of the first and second coils at the winding part are opposite each other.

3. The coil component as claimed in claim 1, wherein the first and second coils do not cross each other at the second drawing part.

4. The coil component as claimed in claim 1, wherein winding directions of the first and fourth coils at the winding part are the same, wherein winding directions of the second and third coils at the winding part are the same, and wherein the winding direction of the first and fourth coils and the winding direction of the second and third coils are opposite each other at the winding part.

5. The coil component as claimed in claim 1, wherein the third and fourth coils do not cross each other at the first drawing part.

6. The coil component as claimed in claim 1, further comprising a fifth terminal electrode provided on the first flange part and a sixth terminal electrode provided on the second flange part, wherein one end of the third coil is connected to the fifth terminal electrode, and other end the third coil is connected to the third terminal electrode, and wherein one end of the fourth coil is connected to the second terminal electrode, and other end the fourth coil is connected to the sixth terminal electrode.

7. The coil component as claimed in claim 1, further comprising fifth and sixth terminal electrodes provided on the first flange part, and seventh and eighth terminal electrodes provided on the second flange part, wherein one end of the third coil is connected to the fifth terminal electrode, and other end the third coil is connected to the seventh terminal electrode, and wherein one end of the fourth coil is connected to the sixth terminal electrode, and other end the fourth coil is connected to the eighth terminal electrode.

8. The coil component as claimed in claim 1, wherein a length of the first drawing part in the axial direction is larger than a length of the second drawing part in the axial direction.

9. The coil component as claimed in claim 8, wherein the first and second coils cross each other at the first drawing part such that the first coil covers the second coil on the winding core part, and wherein the third and fourth coils cross each other at the second drawing part such that the fourth coil covers the third coil on the winding core part.

10. A coil component comprising:

a core including first and second flange parts and a winding core part positioned between the first and second flange parts;

a plurality of first terminal electrodes provided on the first flange part;

a plurality of second terminal electrodes provided on the second flange part; and first, second, third and fourth coils wound around the winding core part, wherein the winding direction of the first and fourth coils and the winding direction of the second and third coils are opposite each other at the winding part, one end of the first coil and one end of the fourth coil are connected to different ones of the first terminal electrodes, one end of the second coil and one end of the third coil are connected to different ones of the first terminal electrodes, other end of the first coil and other end of the fourth coil are connected to different ones of the second terminal electrodes, other end of the second coil and other end of the third coil are connected to different ones of the second terminal electrodes, each of the first and third coils is constituted by a greater number of wires than each of the second and fourth coils, the first and fourth coils are wound on the second and third coils, the first and second coils cross each other a plurality of times, the third and fourth coils cross each other a plurality of times, and a first crossing angle between the first and second coils at a crossing point that is nearest to the first flange part is greater than a second crossing angle between the third and fourth coils at a crossing point that is nearest to the second flange part.

11. The coil component as claimed in claim 10, wherein the one end of the second coil and the one end of the fourth coil are connected to a same one of the first terminal electrodes, and the other end of the first coil and the other end of the third coil are connected to a same one of the second terminal electrodes.

12. The coil component as claimed in claim 10, wherein the one end of the second coil and the one end of the fourth coil are connected to different ones of the first terminal electrodes, and the other end of the first coil and the other end of the third coil are connected to different ones of the second terminal electrodes.

13. The coil component as claimed in claim 10, wherein each of the first and third coils is constituted by more than one wires, and each of the second and fourth coils is constituted by a single wire.

14. A coil component comprising:

a core including first and second flange parts and a winding core part positioned between the first and second flange parts;

first, second, and third terminal electrodes provided on the first flange part;

fourth, fifth, and sixth terminal electrodes provided on the second flange part; and six coils wound around the winding core part, wherein one ends of two of the six coils are connected in common to the first terminal electrode, one ends of another two of the six coils are connected in common to the second terminal electrode, one ends of remaining two of the six coils are connected in common to the third terminal electrode, other ends of four of the six coils are connected in common to the fourth terminal electrode, other ends of another one of the six coils are connected to the fifth terminal electrode, and other ends of remaining one of the six coils are connected to the sixth terminal electrode.

15. The coil component as claimed in claim 14, wherein a number of wires connected to the fourth terminal electrode is different from each of number of wires connected to the first, second, and third terminal electrodes.

16. The coil component as claimed in claim 15, wherein each number of wires connected to the fifth and sixth terminal electrodes is different from each of the number of wires connected to the first, second, and third terminal electrodes.

17. The coil component as claimed in claim 16, wherein the number of wires connected to the first, second, and third terminal electrodes are the same as one another.

* * * * *